US008474649B1

(12) United States Patent
Migliozzi

(10) Patent No.: US 8,474,649 B1
(45) Date of Patent: Jul. 2, 2013

(54) ICE CREAM SERVING BOWL

(76) Inventor: Susan Wood Migliozzi, Grass Valley, CA (US)

( * ) Notice: Subject to any disclaimer, the term of this patent is extended or adjusted under 35 U.S.C. 154(b) by 559 days.

(21) Appl. No.: 12/658,285

(22) Filed: Feb. 8, 2010

(51) Int. Cl.
*B65D 83/72* (2006.01)

(52) U.S. Cl.
USPC ..... 220/592.21; 220/592.14; 62/457.9

(58) Field of Classification Search
USPC ..... 220/592.14, 592.09, 592.15, 592.11, 220/592.2, 592.21, 495.03; 426/100, 524; 62/457.6, 457.9
See application file for complete search history.

(56) References Cited

U.S. PATENT DOCUMENTS 3,413,820 A * 12/1968 Paquin ..... 62/371
5,718,124 A * 2/1998 Senecal ..... 62/457.6
5,782,094 A * 7/1998 Freeman ..... 62/3.6
6,213,336 B1 * 4/2001 Lin ..... 220/592.17
6,651,445 B1 * 11/2003 Clark et al. ..... 62/3.6
6,658,858 B1 * 12/2003 Thompson et al. ..... 62/3.6
6,668,579 B1 * 12/2003 Bigwood et al. ..... 62/457.6
6,763,665 B2 * 7/2004 Clark et al. ..... 62/3.6
6,976,371 B2 * 12/2005 Gleason et al. ..... 62/457.9
7,308,796 B1 * 12/2007 Eager ..... 62/3.2
7,427,001 B1 * 9/2008 Keitges ..... 220/574.2

OTHER PUBLICATIONS www.kitchenkapers.com; Oggi Hot/Cold Stainless Steel Non-Electric Thermal Serving Tray 7109.

* cited by examiner

*Primary Examiner* — Jacob K Ackun
*Assistant Examiner* — Jenine Pagan
(74) *Attorney, Agent, or Firm* — Heisler & Associates

(57) ABSTRACT

A serving dish, such as in the form of a bowl is provided including an upper receptacle and a lower enclosure. The upper receptacle, in the form of a basin, supports a food item to be served frozen, such as ice cream. The lower enclosure, in the form of a stand, includes an interior containing a thermal mass therein. Materials forming the basin have a higher than average thermal conductivity, to relatively rapidly conduct heat away from chilled food items served within the basin. The thermal mass within the interior of the stand has a higher than average specific heat. When the stand and included thermal mass are pre-chilled, large amounts of heat can be rapidly conducted from food items within the basin, down into the thermal mass. Food items served within the basin of the bowl can thus be kept frozen during a serving period.

7 Claims, 2 Drawing Sheets

ICE CREAM SERVING BOWL

FIELD OF THE INVENTION

The following invention relates to serving dishes for serving of food items. More particularly, this invention relates to serving dishes which are configured to allow the food items to be kept cold for an extended period of time after serving, such as to keep ice cream frozen or substantially frozen, or otherwise kept at an intended serving temperature for a longer period of time after serving.

BACKGROUND OF THE INVENTION

Serving dishes exhibit a mixture of aesthetic and functional attributes to most beneficially support and present food items before and during the meal experience. Such dishes can come in a variety of different configurations geometrically with adjustments based on size to accommodate larger or smaller servings and adjustments in shape, such as with a flatter plate-like form or a more curved bowl-like form, both for aesthetics and to accommodate containment of liquids or solids which have a tendency to migrate if not laterally supported.

Typically, such dishes only vary in appearance, shape and material to optimize food containment attributes and to optimize visual aesthetics. In some instances, it is known to adjust a temperature of a serving dish to enhance the performance of the dish. For instance, it is known in some instances to keep dishes in a freezer and then serve food items on a cold dish. For instance, serving salad on a cold dish can keep the lettuce crisp more effectively than serving the salad on a hot dish. It is also known to use a cold glass to serve beer (or root beer) to provide a "frosty mug" presentation.

Furthermore, it is known to form dishes of different materials which will have a different thermal performance relative to the food. For instance, a ceramic dish might be utilized for serving hot foods so that the person enjoying the food item on the dish is less susceptible to being burned if incidentally touching the dish. Because ceramic materials have a relatively lower than average thermal conductivity, even if the dish is touched, rates of heat transfer into the person touching the dish are sufficiently low that a burn is avoided.

When food items are served which benefit from being kept cold after initial serving, the utilization of dishes that have been kept in a freezer has only limited effectiveness in keeping the food items served thereon cold or frozen. In particular, dishes typically have a single walled form with a limited mass between opposite surfaces thereof. Even with dishes formed of a material having a higher than average heat capacity, only a limited amount of heat transfer is facilitated from the food items served on the dish to an interior of the material forming the dish, to keep the food items served on the dish hot or cold. Heat transfer from surrounding air into the food item is typically at a higher rate than heat transfer from the food item into the dish, so that the food item will melt or become warm and transition to a temperature above freezing rather rapidly. Furthermore, the total heat capacity of the dish is limited so that, once exceeded, rapid warming of the food item served on the dish will occur.

One attempt at a hot or cold serving dish that is known in the prior art is the "Hot or Cold Stainless Thermal Serving Tray" provided by Oggi Corporation of Anaheim, Calif., and which was available for sale at www.kitchenkapers.com on Oct. 30, 2009. The product is formed of stainless steel and is described as having a "gel core." This tray is designed for food distribution, rather than as a dish for holding foods while eating, having a platter form rather than a bowl form. Also, while this device has a potential cooling effect, it is not described as capable of performing at below freezing temperatures, such as to keep ice cream frozen.

When serving ice cream, it is often desirable to maintain the ice cream below freezing for as long as possible. The person enjoying the ice cream can then enjoy the experience of having the ice cream melt in one's mouth, rather than already being melted upon the serving dish. Prior art serving dishes have been ineffective in keeping ice cream frozen for a long enough period to allow the user of the dish to enjoy the entire serving of ice cream with the ice cream remaining frozen through at least a majority of the time that the ice cream is being served. Accordingly, a need exists for a serving dish which can effectively support and serve ice cream or other food items, while keeping the ice cream frozen, even with addition of a hot topping, for a longer period of time than has been possible with prior art serving dishes.

SUMMARY OF THE INVENTION

With this invention, a serving dish is provided, generally in the form of a bowl in a preferred embodiment disclosed herein. This serving bowl includes two separate portions including an upper receptacle in the form of a basin in the preferred embodiment and a lower enclosure in the form of a stand in the preferred embodiment. The upper receptacle has an open upper end and a side providing lateral support for ice cream or other food items (e.g. frozen yogurt, sherbet, gelato etc.) served within the upper receptacle.

The lower enclosure has an interior which is substantially closed and contains a thermal mass therein. An interface is provided between the upper receptacle and the lower enclosure which facilitates heat transfer between the upper receptacle and the lower enclosure. The upper receptacle and at least upper portions of the lower enclosure are formed of a material having a higher than average thermal conductivity. Heat can thus move at a high rate of heat transfer from food items, such as ice cream, served within the upper receptacle to the thermal mass within the interior of the lower enclosure.

The thermal mass has a higher than average heat capacity so that heat transfer from the food items within the upper receptacle can continue for a long period of time into the thermal mass. While the dish is shown herein with a particular configuration, the geometric configuration of the serving dish of this invention can vary to meet the aesthetic desires and the volume desires of the end user.

The basin and stand can be fixed together or removably attachable, with a threaded or other fastener that provides a large surface area of contact for heat transfer when connected. In such a embodiment, only the stand need be chilled before use. To enhance heat transfer, a heat sink can be provided inside the lower enclosure with fins or posts extending down from the top wall of the stand.

OBJECTS OF THE INVENTION

Accordingly, a primary object of the present invention is to provide a serving dish which can serve ice cream and keep the ice cream frozen after being served, even in a room temperature or above room temperature environment.

Another object of the present invention is to provide a serving dish which can keep a food item frozen after serving in an above freezing environment for extended periods of time.

Another object of the present invention is to provide a serving dish which facilitates heat transfer away from a food item to keep the food item frozen after being served.

Another object of the present invention is to provide a method for keeping a food item cold for a long period of time after serving.

Another object of the present invention is to provide a serving bowl which has a desirable aesthetic appearance both through geometric form and through facilitation of the formation of frost on the serving dish.

Other further objects of the present invention will become apparent from a careful reading of the included drawing figures, the claims and detailed description of the invention.

DESCRIPTION OF THE PREFERRED EMBODIMENT

Figure 1:
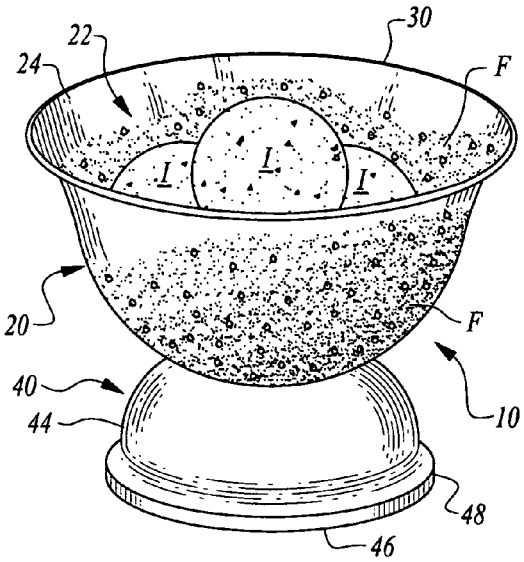
FIG. 1 is a perspective view of a bowl defining a preferred embodiment of the dish of this invention and with ice cream served therein and with frost formed on inside and outside surfaces of a basin portion of the dish.
Figure 2:
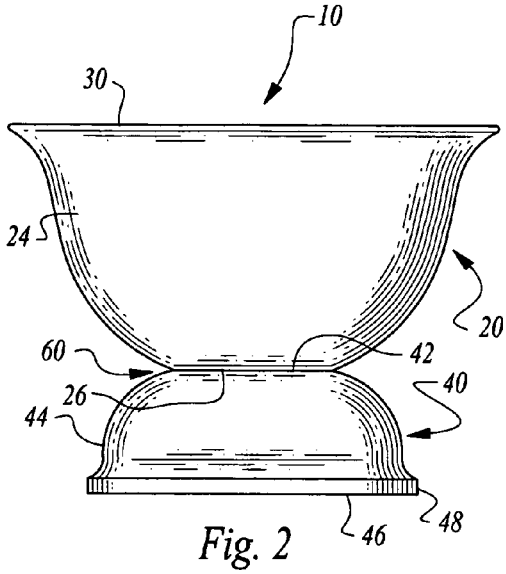
FIG. 2 is a front elevation view of that which is shown in FIG. 1.

Referring to the drawings, wherein like reference numerals represent like parts throughout the various drawing figures, reference numeral 10 is directed to a bowl defining a preferred embodiment of a dish for serving of frozen foods such as ice cream I (FIG. 1). The bowl 10 is configured to keep the ice cream I or other food items frozen after serving for an extended period of time in a room temperature or hotter environment. The bowl 10 or other dish also maintains a below freezing temperature and sufficiently high rate of heat transfer that in at least moderately humid environments will cause frost to form on inner and outer surfaces of the bowl 10 or other dish to provide a desirable aesthetic appearance.

Figure 5:
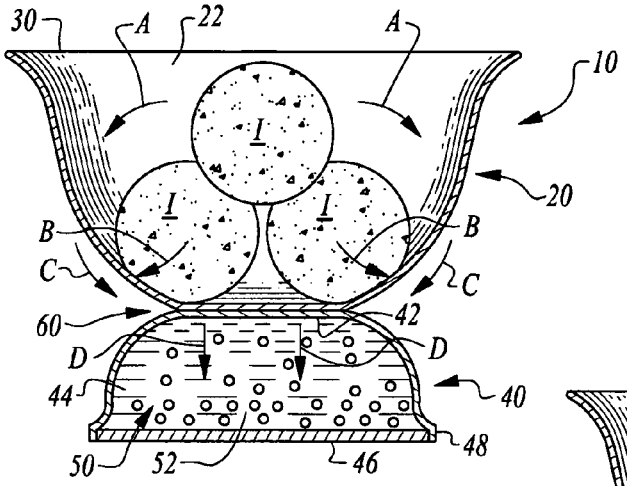
FIG. 5 is a front elevation full sectional view of that which is shown in FIG. 1 and with various arrows illustrating heat transfer from ice cream served within the basin of the dish to a thermal mass contained within an interior of the stand of the dish to keep the ice cream frozen within the basin portion of the dish for an extended period.

In essence, and with particular reference to FIGS. 1 and 5, basic details of the bowl 10 of this invention are provided, defining a preferred embodiment of dish for supporting frozen or cold food items and keeping them cold or frozen for an extended period. The bowl 10 includes two main portions including a basin 20 defining a preferred form of upper receptacle and a stand 40 defining a preferred form of lower enclosure. The basin 20 includes a rim 30 surrounding an open upper end of the basin 20. The basin 20 includes a bottom surface 28 in heat transfer contact with a top wall 42 of the stand 40.

The stand 40 includes an interior 50 which contains a thermal mass 52 therein. A joint 60 defines a preferred form of interface between the basin 20 and stand 40 to facilitate heat transfer from the basin 20 to the stand 40 and then into the thermal mass 52 within the interior 50 of the stand 40. Heat transfer is thus facilitated from the ice cream I or other food items within the basin 20, into the surfaces forming the basin 20 of the bowl 10, then into the stand 40 across the joint 60, and finally into the thermal mass 52 within the interior 50 of the stand 40.

Materials forming the basin 20 and at least upper portions of the stand 40 have a higher than average thermal conductivity. The thermal mass 52 has a higher than average heat capacity. In this way, elevated rates of heat transfer are attained and maintained for an extended period of time, exceeding rates of heat transfer from surrounding air into the ice cream I or other food items so that the ice cream I or other food items remain frozen within the basin 20 of the bowl 10 for an extended period of time.

More specifically, and with particular reference to FIGS. 1-5, details of the basin 20, defining a preferred form of the upper receptacle are described, according to this preferred embodiment. While the bowl 10 is preferred having a basin 20 with sides that extend up to the rim 30, the dish could have many other different configurations, from more bowl-like to more plate-like, and even potentially entirely planar and horizontal. In this preferred embodiment, the basin 20 has a steep curving surface 24 defining a preferred form of side for the basin 20. A bottom surface 26 below the curving surface 24 or other side closes a lower end of the basin 20 and is preferably planar, but at least conforms to a contour of a top wall 42 of the stand 40. The basin 20 defines a preferred form of upper receptacle. The basin 20 thus defines that portion of the bowl 10 or other dish which is adapted to support food items therein.

A recess 22 defines the portion of the basin 20 where the food items such as ice cream I are contained. While the curving surface 24 is most preferred, the side of the basin 20 or other upper receptacle could be flat and faceted rather than curving. The basin 20 is shown with a radially symmetrical form about a central vertically extending axis. However, the basin 20 could have a more irregular shape or a regular but not curving form, and still function effectively according to this invention.

The curving surface 24 has both an inside surface and an outside surface with a thickness of the material forming the basin defining a spacing between these inner and outer surfaces. This thickness is preferably selected to be substantially uniform over all portions of the curving surface 24 defining the basin 20. As an alternative, the basin 20 could have varying thicknesses to adjust rates of heat transfer and/or to accommodate structural strength needs for the basin 20.

Most preferably, the basin 20 or other upper receptacle is formed of a metal material that is suitable for use as a serving dish. Such suitability is determined by factors such as the ability to be cleaned effectively and a resistance to retainment of food particles thereon, so that the basin 20 can be effectively cleaned, and having a desirable appearance. One suitable material is stainless steel. Another option would be aluminum, possibly coated as is known in the food serving art.

At a minimum, material forming the basin 20 has a higher than average thermal conductivity. When reference is made to materials having a higher than average thermal conductivity, what is defined is materials which, when compared to all commonly available materials ranked according to their thermal conductivity, materials which are higher than average on such a list are distinguished from materials that are lower than average. For purposes of this invention, and to specifically define a midpoint between higher than average and lower than average thermal conductivity, a midpoint of 1.0 watts per meter degree Kelvin (w/m° K) is established. Substantially all metals would be considered higher than average with most ceramics and silica glasses considered to be lower than average.

The material forming the basin 20 is preferably one that has a higher than average thermal conductivity. In this way, heat can be relatively rapidly transferred from food items within the recess 22 of the basin 20 and into the material forming the curving surface 24 of the basin 20. It is desirable that this rate of heat transfer into the curving surface 24 be faster than rates of heat transfer from surrounding air into the food items. Thus, the temperature of the food item will remain constant or will decrease, rather than increasing and potentially melting or warming to an undesirably high temperature.

Other factors to consider when selecting the material forming the basin include the radiation heat transfer performance of the material and color of the material, which have an effect on rates of radiation heat transfer (as opposed to conduction heat transfer) from the food items contained within the recess 22 of the basin 20 to the curving surface 24. By providing the basin 20 with the form shown, with relatively steep and high sides, a shape factor for radiation heat transfer is optimized, further effectively facilitating heat transfer out of the food items into the curving surface 24 of the basin 20 to keep the food items as cold as possible.

In moderate or high humidity environments air adjacent the curving surface 24, both on inside and outside surfaces thereof will tend to precipitate and freeze moisture in the air, so that frost will accumulate on surfaces of the basin 20. Such frost provides a desirable aesthetic appearance and also communicates to a user that the basin 20 portion of the bowl 10 is cold and should thus be handled appropriately (e.g. without wet fingers). The accumulation and maintenance of frost F on surfaces of the basin 20 also provides visual feedback to the user as to whether or not the bowl 10 is functioning properly according to this invention. When the frost begins to melt, a visual indication is provided that the ability of the bowl 10 or other dish to continue to keep food items frozen is diminishing. A visual cue is thus provided to a user to finish the food consumption process if it is desired that the food be entirely consumed while frozen.

With continuing reference to FIGS. 1-5, details of the stand 40 defining a preferred form of lower enclosure for the bowl 10 of this invention are described. The stand 40 provides one form of lower enclosure which both allows the bowl 10 or other dish to be supported upon a horizontal surface and also contains the thermal mass 52 within the interior 50 of the stand 40 for drawing heat out of food items, such as ice cream I within the basin 20. In this preferred embodiment, the stand 40 includes a top wall 42 which is preferably planar and a side wall 44 which extends from the top wall 42 down to an edge 48.

A base plate 46 preferably closes off a lower portion of the stand 40. This base plate 46 can optionally be made of a material distinct from materials forming the top wall 42 and side wall 44 of the stand 40. For instance, the base plate 46 could be formed of a rubber material or other material having a lower than average thermal conductivity. In this way, the base plate 46 can tend to remain frost free or condensation free to avoid accumulation of moisture upon the table or other surface upon which the bowl 10 rests. A thickness of this base plate 46 can be selected to maximize this attribute of the bowl 10 as desired. Other lower than average thermal conductivity materials, such as plastics, could also be utilized.

Preferably, this base plate 46 is permanently attached to the edge 48 of the side wall 44 to permanently enclose the thermal mass 52 within the interior 50. Alternatively, the base plate 46 could be removably attachable, such as to allow replacement of the thermal mass 52. In one embodiment, the thermal mass 52 could simply be a salt water solution. In which case, the thermal mass 52 could be periodically replaced. Interior portions of the side wall 44 of the stand 40 in such an embodiment could be suitably coated or formed of materials which can avoid corrosion in such a salt water environment.

Most preferably, the top wall 42 and side wall 44 of the stand 40 are formed of a common material with that forming the basin 20. In this way, any propensity for corrosion between the basin 20 and stand 40 are eliminated. Also, rates of heat transfer between the basin 20 and stand 40 remain substantially constant. As an alternative, the stand 40 could be formed of a different material than that forming the basin 20. The stand 40 in any event preferably has its top wall 42 and side walls 44 formed of a material having a higher than average thermal conductivity. As an alternative, the top wall 42 could be the only portion of the stand 40 having a higher than average thermal conductivity with the side walls 44 formed of a material having a lower thermal conductivity than that of the top wall 42, and even potentially a lower than average thermal conductivity. In such a configuration, the stand 40 can further be configured to resist formation of condensation on the stand 40. If desired, the side wall 44 of the stand 40 could be insulated, such as generally in the form of a thermos vacuum bottle configuration with a vacuum space built into the side wall 44.

The top wall 42 preferably has a flat upper side and is sized similar to a size of the bottom surface 28 of the basin 20. The top wall 42 is configured to come into direct contact with the bottom surface 28 of the basin 20 so that conduction heat transfer can occur between the bottom surface 28 of the basin 20 and the top wall 42 of the stand 40. By polishing the bottom surface 28 and top wall 42 to be exceptionally smooth, contact resistance to heat transfer can be reduced. As another alternative, one of the bottom surface 28 or top wall 42 could be eliminated and the joint 60 between the basin 20 and stand 40 provided only at the perimeter of the interface.

The bottom surface 28 and top wall 42 define two sides of the joint 60 defining a preferred form of interface between the basin 20 and the stand 40. This joint 60 is in this preferred embodiment a thick joint formed such as by bonding utilizing a technique such as welding, braising, soldering or adhesive attachment. If an adhesive is utilized, it is desirable that the adhesive cover substantially the entire surface of the top wall 42 that is in contact with the bottom surface 28 and that the adhesive material be sufficiently thin and of a type that is suitable for bonding metals together and maintaining a relatively high rate of heat transfer therethrough. One suitable manner for forming the joint is to utilize an adhesive material such as that supplied under the trademark "J-B WELD" provided by J-B Weld Company, LLC of Boulder, Colo. Epoxies provided by the 3M Company of St. Paul, Minn. can also be used. As an alternative, and described below, this joint 60 can facilitate removable attachability between the stand 40 and the basin 20. As another alternative, the joint 60 can be eliminated and the basin 20 formed integrally with the stand 40.

The interior 50 of the stand 40 is hollow and contains the thermal mass 52 therein. The interior 50 is sufficiently large in volume so the thermal mass 52 contained therein can absorb enough heat to keep the food items, such as ice cream I, frozen or cooled to a desired temperature within the basin 20 for the amount of time typically required for consumption of the food item contained within the basin 20. Typically, such a time period might be ten to fifteen minutes when utilized in a room temperature environment (i.e. 70° F.) and with the food item, such as ice cream I, remaining below a freezing point for ice cream for the duration of the serving time. Most preferably, the interior 50 is sufficiently large that the thermal mass 52 can continue to absorb heat from the food item, such as ice cream I, even in a high temperature environment, such as on a hot summer day (i.e. over 100° F.) for a full fifteen minute serving time (or longer).

The thermal mass 52 is selected to have a higher than average heat capacity (such as defined by the "specific heat" value for the material in Joules per kilogram degree Kelvin (J/kg° K) so that the thermal mass 52 can continue to draw heat from the food items, such as ice cream I within the basin 20 for a long period of time. For purposes of this invention materials of average thermal capacity have a numerical value of specific heat of 1000 J/kg° K which is approximately the specific heat of air, with most metals having a lower heat capacity.

In one form of the invention such thermal capacity is maximized for the thermal mass 52 by forming the thermal mass 52 from a material which transitions between a liquid and solid state at a temperature above typical residential freezer temperatures, but below the freezing point of water. With such a configuration for the thermal mass 52 (a freezing point of approximately 25° F. to 30° F.) the thermal mass 52 will freeze into a solid state when placed within a freezer. When the bowl 10 is later utilized, the thermal mass 52 will slowly (due to its high heat capacity) increase in temperature until it reaches its melting point. The thermal mass 52 will then continue to draw heat from food items within the bowl 10 while the latent heat of fusion is absorbed by the thermal mass 52 and the temperature continues to be maintained at this freezing temperature for the thermal mass 52.

After the thermal mass 52 has entirely melted, the thermal mass 52 will again continue to increase in temperature (slowly due to the high heat capacity) until equilibrium is reached between a temperature of surrounding environments and the temperature of the thermal mass 52. This serving experience is preferably completed before the thermal mass 52 has entirely melted, or shortly thereafter, so that the food item within the bowl 10 remains frozen throughout the serving experience. One material suitable for use as the thermal mass 52 is provided under the trademark "BLUE ICE" provided by Rubbermaid Incorporated of Atlanta, Ga.

Figure 7:
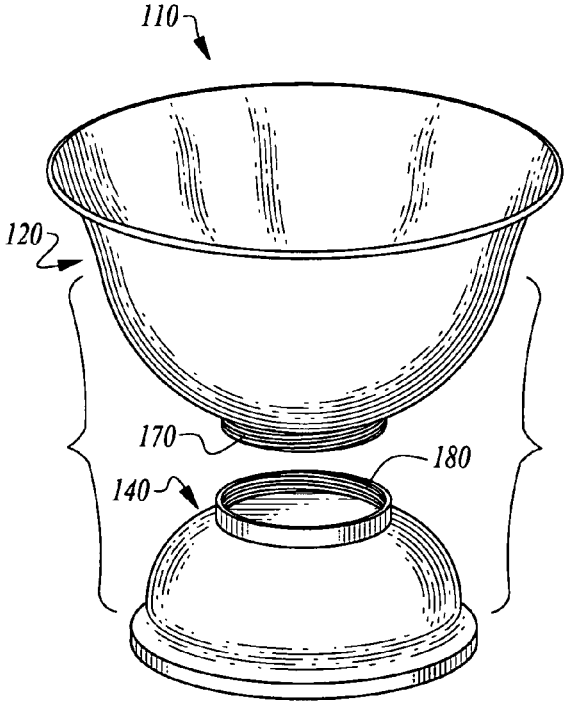
FIG. 7 is a perspective view of an alternative embodiment of that which is shown in FIG. 1 where the stand portion and the basin portion of the bowl are removably attachable to each other, such as to facilitate chilling of just a stand of the bowl within a freezer before use by coupling the stand to the bowl.

With particular reference to FIG. 7, details of a first alternative bowl 110 are described. This first alternative bowl 110 uniquely provides a removable two part configuration, where the basin 120 can be removably attached to the stand 140. In particular, a threaded cylinder 170 and threaded ring 180 are provided which are formed complemental to each other. In FIG. 7 the threaded cylinder 170 is shown on the bottom of the basin 120 with threaded ring 180 extending up from a top of the stand 140. The threaded cylinder 170 and threaded ring 180 could be swapped in position and still function similarly. Depths of the threaded cylinder 170 and threaded ring 180 are selected along with pitches of the threads to cause substantially planar flat (or otherwise complementally shaped) surfaces of the basin 120 and stand 140 to come into direct contact with each other to maximize conduction heat transfer between the basin 120 and the stand 140.

With the bowl 110, it is not required that the entire bowl 110 be placed within a freezer before use. Rather, only the stands 140 need be placed within a freezer. In this way, a larger number of bowls 110 can be utilized simultaneously, such as with perhaps as many as a dozen or more stands 140 first placed within a freezer and a relatively small amount of space required within the freezer. When the food is ready to be served, the stands 140 are removed from the freezer and attached to the basins 120. The basins 120 will rapidly cool due to the relatively high thermal conductivity of the materials forming the basin 120 and stand 140. Food items, such as ice cream I can then be placed within the basin 120 with the bowl 110 effectively keeping the ice cream I or other food items frozen by drawing heat into the thermal mass within the stand 140.

Figure 4:
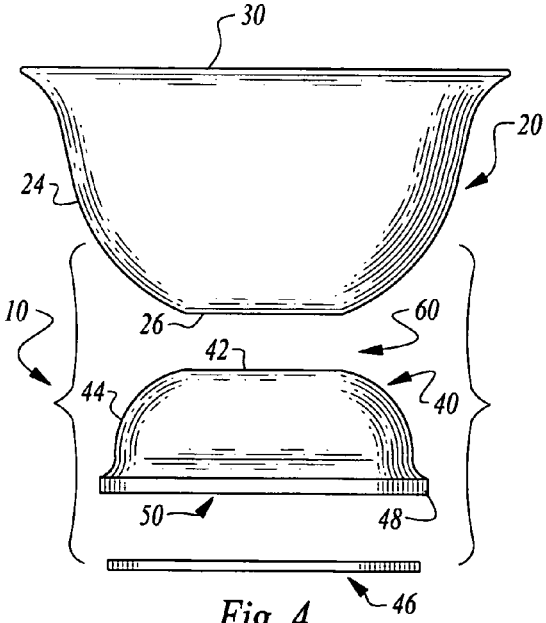
FIG. 4 is a front elevation exploded parts view of that which is shown in FIG. 1.
Figure 3:
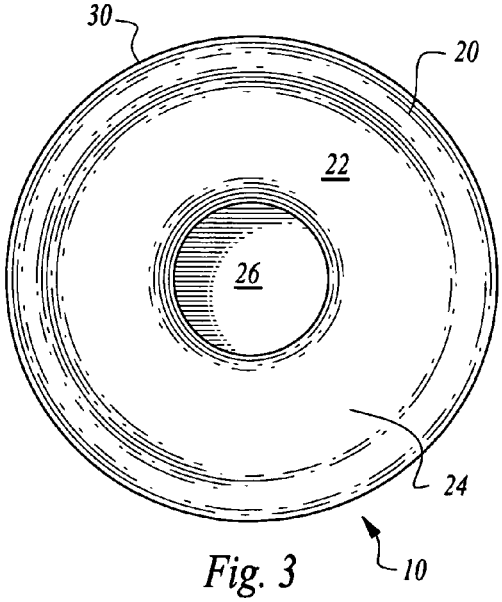
FIG. 3 is a top plan view of that which is shown in FIG. 1.
Figure 6:
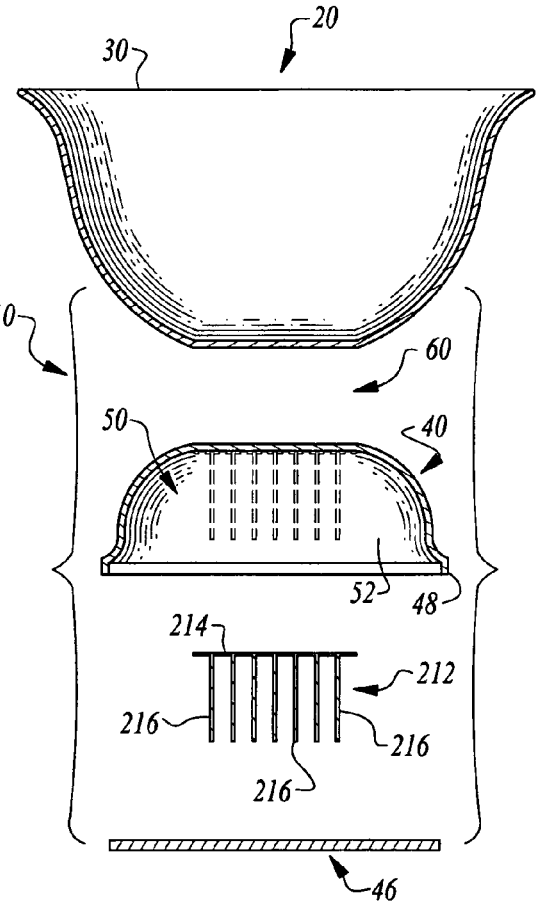
FIG. 6 is a front elevation full sectional exploded parts view of an alternative embodiment of that which is shown in FIG. 1 which includes an optional heat sink within an interior of the stand portion of the invention.

With particular reference to FIG. 6, details of a second alternative bowl 210 are described. The second alternative bowl 210 is similar to the bowl 10 of the preferred embodiment except that a heat sink 212 is optionally provided within the interior 50. The heat sink 212 works in conjunction with the thermal mass 52 to increase a rate of heat transfer into the thermal mass 52. In particular, the heat sink 212 includes a support plate 214 in conduction heat transfer contact with an underside of the top wall 42 of the stand 40 (FIGS. 4 and 5). The support plate 214 has a series of fins or posts 216 (or other downwardly extending elements) extending down from the support plate 214.

Both the support plate 214 and the fins or posts 216 provide a large amount of surface area to maximize rates of heat transfer to the thermal mass 52. The fins or posts 216 can be replaced with any form of downwardly extending elements extending down from the support plate 214 into the thermal mass 52 (FIG. 5). These downwardly extending elements would typically not come into contact with the base plate 46. The heat sink 212 is formed of a material having a higher than average thermal conductivity to rapidly draw heat from the basin 30, across the junction 60 to the stand 40, and then into the thermal mass 52. The heat sink 212 can increase overall rates of heat transfer from the ice cream I or other food items within the basin 20. Such augmentation of the rate of heat transfer might be desirable in certain situations, such as when utilizing the bowl 10 on exceptionally hot days outside, or in other high temperature environments, where enjoying ice cream I or other food items would be particularly desirable and a higher rate of heat transfer is required to keep the ice cream I frozen.

In use and operation, and with particular reference to FIG. 5, details of the function of the bowl 10 of this invention according to a preferred embodiment, are described. Initially, the bowl 10, including the basin 20, the stand 40 and the thermal mass 52 within the interior 50 of the stand 40 are all at room temperature. To prepare the bowl 10 for use, the bowl 10 is placed in a cold location, such as the interior of a freezer. While the bowl 10 is in the freezer, heat is transferred from the bowl 10 (including the thermal mass 52) into the freezer. The bowl 10 is preferably left in the freezer until the entire bowl 10, including the basin 20, stand 40 and thermal mass 52 have all attained a temperature substantially similar to that of the interior of the freezer (e.g. 25° F.). In a preferred embodiment where it is desired for the bowl 10 to contain ice cream I below freezing, this temperature is somewhat lower than the freezing temperature of water. Also, this temperature is preferably below a freezing point of the thermal mass 52 so that the thermal mass 52 freezes from a liquid state to a solid state.

In embodiments of this invention where the stand 40 is removably attachable to the basin 20, it is only required that the stand 40 and included thermal mass 52 be placed within the freezer or other cold location. After the bowl 10 has been completely cooled, and when it is desired to serve ice cream I or other chilled food items, the bowl 10 is removed from the freezer and loaded with ice cream I or other chilled food items. If the stand 40 is removably from the basin 20, the stand 40 would first be attached to the basin 20 before loading the ice cream I or other food items therein.

If desired, the bowl 10 can be allowed to stand, especially in a relatively high humidity room temperature environment, so that frost forms on inner and outer surfaces of the basin 20. Also, at least upper portions of the stand 40 would typically collect frost thereon. These frost crystals provide a pleasing aesthetic appearance for the bowl 10.

The ice cream I or other food items are then served to a consumer within the bowl 10 and the ice cream I can be enjoyed while frozen. During the time that the ice cream I or other food items are being enjoyed while resting in the bowl 10, the bowl 10 continues to draw heat out of the ice cream I or other food items. This rate of heat transfer out of the ice cream I is preferably higher than the rate of heat transfer from surrounding air into the ice cream I. Thus, the ice cream I resists melting, but rather remains frozen during the consuming process.

In particular, heat is transferred from the ice cream I to the bowl 10 through heat transfer into the basin 20. This heat transfer occurs by conduction (along arrow B of FIG. 5) where the ice cream I touches the curving surface 24 or bottom surface 26 of the basin 20. This heat transfer also occurs by radiation heat transfer (along arrow A) from the ice cream I to the inside surface of the basin 20.

Because the basin 20 is preferably formed of metal or other high thermal conductivity material, the heat drawn from the ice cream I into the basin 20 is rapidly transferred down to the stand 40, through the interface joint 60 between the bottom surface 28 of the basin 20 and the top wall 42 of the stand 40 (along arrow C of FIG. 5). Heat transfer then continues into the thermal mass 52 (along arrow D of FIG. 5).

As heat is transferred into this thermal mass 52, the thermal mass will initially increase in temperature until its melting point is reached. Then the thermal mass 52 will remain at a constant temperature while the thermal mass 52 transitions from a solid state to a liquid state. During this transition, heat continues to be transferred out of the ice cream I or other food items within the basin 20. Finally, when the thermal mass 52 is completely melted, the thermal mass 52 will continue to increase in temperature. Eventually, the thermal mass 52 will have attained a temperature above freezing. However, this amount of time before the thermal mass 52 reaches room temperature is designed to be sufficiently long so that the ice cream I or other food items will have been completely enjoyed before the bowl 10 loses its effectiveness.

One indicator that the bowl 10 is about to warm up to above the freezing point is that the frost F (FIG. 1) will begin to melt on upper portions of the basin 20, most distant from the thermal mass 52. When this frost F adjacent the rim 30 begins to melt, a consumer of the ice cream I or other chilled food items receives a warning that the bowl 10 is about to lose its effectiveness, and so the ice cream I should be finished off before the ice cream I will begin to melt.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A dish for serving chilled food while tending to keep the foods therein chilled, the dish comprising in combination:

an upper receptacle having an open upper end adapted to allow access into a recess;

said upper receptacle surrounded laterally by at least one side;

said side formed of a rigid material;

a lower enclosure, said lower enclosure abutting the upper receptacle at an interface adapted to allow heat transfer between said upper receptacle and said lower enclosure;

said lower enclosure having at least portions thereof adjacent said upper receptacle;

said lower enclosure substantially enclosing an interior space;

a thermal mass located within said interior space of said lower enclosure, said thermal mass formed of a material having a greater than average heat capacity;

wherein said side of said upper receptacle extends down from said open upper end to join a substantially flat bottom surface, said bottom surface of said upper receptacle defining at least a portion of said interface with said lower enclosure, said lower enclosure having a substantially flat top wall abutting said bottom surface, said top wall of said lower enclosure defining a second portion of said interface between said upper receptacle and said lower enclosure;

wherein said bottom surface of said upper receptacle and said top wall of said lower enclosure are removably attached together with direct contact when attached to facilitate conduction heat transfer between said bottom surface of said upper receptacle and said top wall of said lower enclosure; and wherein a complementally formed threaded ring and threaded cylinder define two portions of said interface between said bottom surface of said upper receptacle and said top wall of said lower enclosure, with one of said threaded ring and said threaded cylinder fixed to said bottom surface of said upper receptacle and one of said threaded ring and said threaded cylinder fixed to said top wall of said lower enclosure, with said threaded ring and said threaded cylinder removably attachable to each other and providing direct conduction heat transfer between said bottom surface of said upper receptacle and said top wall of said lower enclosure, when said threaded ring and said threaded cylinder are mated together.

2. The dish of claim 1 wherein said open upper end of said upper receptacle is surrounded by a rim, said rim defining an uppermost portion of said side of said upper receptacle.

3. The dish of claim 2 wherein said at least one side of said upper receptacle includes a single layer of material defining both inner and outer side surfaces.

4. The dish of claim 3 wherein said single side of said upper receptacle has a curving form as said single side extends down from said rim with a curving contour for at least portions of said single side.

5. The dish of claim 4 wherein said single side extends down from said rim to join a flat bottom surface defining at least a portion of said interface with said lower enclosure.

6. The dish of claim 1 wherein said bottom surface of said upper receptacle and said top wall of said lower enclosure are fixedly attached together in direct contact to facilitate conduction heat transfer between said bottom surface of said upper receptacle and said top wall of said lower enclosure.

7. A dish for serving chilled food while tending to keep the foods therein chilled, the dish comprising in combination:

an upper receptacle having an open upper end adapted to allow access into a recess;

said upper receptacle surrounded laterally by at least one side;

said side formed of a rigid material;

a lower enclosure, said lower enclosure abutting the upper receptacle at an interface adapted to allow heat transfer between said upper receptacle and said lower enclosure;

said lower enclosure having at least portions thereof adjacent said upper receptacle;

said lower enclosure substantially enclosing an interior space;

a thermal mass located within said interior space of said lower enclosure, said thermal mass formed of a material having a greater than average heat capacity;

wherein said side of said upper receptacle extends down from said open upper end to join a substantially flat bottom surface, said bottom surface of said upper receptacle defining at least a portion of said interface with said lower enclosure, said lower enclosure having a substantially flat top wall abutting said bottom surface, said top wall of said lower enclosure defining a second portion of said interface between said upper receptacle and said lower enclosure; and wherein said substantially flat top wall of said lower enclosure includes a heat sink within said interior of said lower enclosure and in contact with an underside of said substantially flat top wall, said heat sink extending down with at least one downwardly extending element from said top wall of said lower enclosure and formed of a material having a higher than average thermal conductivity.

* * * * *